US011462154B1

(12) United States Patent
Chang et al.

(10) Patent No.: US 11,462,154 B1
(45) Date of Patent: Oct. 4, 2022

(54) DISPLAY SYSTEM CAPABLE OF ELIMINATING CROSS-CHANNEL COUPLING PROBLEM, AND DRIVING DEVICE THEREOF

(71) Applicant: MACROBLOCK. INC., Hsinchu (TW)

(72) Inventors: Che-Wei Chang, Hsinchu (TW); Chen-Yuan Kuo, Hsinchu (TW); Chi-Min Hsieh, Hsinchu (TW)

(73) Assignee: MACROBLOCK. INC., Hsinchu (TW)

( * ) Notice: Subject to any disclaimer, the term of this patent is extended or adjusted under 35 U.S.C. 154(b) by 0 days.

(21) Appl. No.: 17/653,734

(22) Filed: Mar. 7, 2022

(30) Foreign Application Priority Data

Mar. 11, 2021 (TW) ..... 110108673

(51) Int. Cl.
*G09G 3/32* (2016.01)

(52) U.S. Cl.
CPC ..... *G09G 3/32* (2013.01); *G09G 2300/0833* (2013.01); *G09G 2310/0202* (2013.01); *G09G 2320/0209* (2013.01); *G09G 2330/02* (2013.01)

(58) Field of Classification Search
CPC ..... G09G 3/32; G09G 2300/0833; G09G 2310/0202; G09G 2320/0209; G09G 2330/02
See application file for complete search history.

(56) References Cited

U.S. PATENT DOCUMENTS

2015/0009105 A1* 1/2015 Nomura ..... H01L 27/3276 345/76
2018/0047799 A1* 2/2018 Lim ..... H01L 27/3248
2019/0189955 A1* 6/2019 Sakamoto ..... G09G 3/3225
2020/0043405 A1* 2/2020 Akimoto ..... G09G 3/3233
2020/0302876 A1* 9/2020 Shin ..... G09G 3/3677
2020/0321322 A1* 10/2020 Kim ..... H01L 25/0753

* cited by examiner

*Primary Examiner* — Andrew Sasinowski
(74) *Attorney, Agent, or Firm* — Akerman LLP; Peter A. Chiabotti

(57) ABSTRACT

A display system includes an LED array and a driving device. The driving device includes a current driver, a scan selector and a capacitor. The current driver is connected to drive lines of the LED array, and provides a plurality of driving current signals respectively to the drive lines. The scan selector is connected to scan lines of the LED array, and has a first terminal that is configured to receive an input voltage, and a second terminal. The scan selector outputs the input voltage to a selected one of the scan lines, and outputs a clamp voltage provided at the second terminal thereof to the other ones of the scan lines. The capacitor has a first terminal, and a second terminal that is connected to the second terminal of the scan selector.

18 Claims, 13 Drawing Sheets

DISPLAY SYSTEM CAPABLE OF ELIMINATING CROSS-CHANNEL COUPLING PROBLEM, AND DRIVING DEVICE THEREOF

CROSS-REFERENCE TO RELATED APPLICATION

This application claims priority of Taiwanese Patent Application No. 110108673, filed on Mar. 11, 2021.

FIELD

The disclosure relates to display techniques, and more particularly to a display system capable of eliminating cross-channel coupling problem and a driving device thereof.

BACKGROUND

Alight emitting diode (LED) array is driven to emit light in a line scan manner. For each line of the line scan of the LED array, a dark pixel of the line would be affected by a bright pixel of the line to produce a different brightness than what would be expected. This is the so called cross-channel coupling problem. The cross-channel coupling problem inevitably occurs in the LED array because of coupling paths established by parasitic capacitances of LEDs of the LED array. During an active time of the line, a current source for driving the LED corresponding to the bright pixel is enabled before a current source for driving the LED corresponding to the dark pixel is enabled. Upon the enabling of the current source for driving the LED corresponding to the bright pixel, the current source for driving the LED corresponding to the bright pixel generates a drive current with a fixed non-zero magnitude, only a portion of the drive current would flow through the LED corresponding to the bright pixel since a voltage across the LED corresponding to the bright pixel is not sufficiently large, and another portion of the drive current (i.e., a coupling current) would flow through the parasitic capacitance of the LED corresponding to the dark pixel. Therefore, the voltage across the LED corresponding to the dark pixel would change before the current source for driving the LED corresponding to the dark pixel is enabled, making the brightness of the dark pixel different than expected.

In Chinese Patent No. 106251806B, in order to eliminate the cross-channel coupling problem, for each line of the line scan of the LED array, the active time of the line is divided into alternating group display intervals and reset intervals, pixels of the line are divided into multiple groups according to the expected brightness of the pixels, each group of the pixels is driven to emit light in a respective one of the group display intervals, and the parasitic capacitances of the LEDs in the line are pre-charged in the reset intervals. As such, utility rate of the LEDs decreases. In addition, the parasitic capacitances of the LEDs are charged and discharged repeatedly, resulting in high power consumption of the LED array.

SUMMARY

Therefore, an object of the disclosure is to provide a display system that can eliminate cross-channel coupling problem and provide a driving device thereof.

According to an aspect of the disclosure, the display system includes a light emitting diode (LED) array and a driving device. The LED array includes a plurality of scan lines, a plurality of drive lines and a plurality of LEDs. The LEDs are arranged in a matrix that has a plurality of rows respectively corresponding to the scan lines and a plurality of columns respectively corresponding to the drive lines. Each of the LEDs has a first terminal and a second terminal. With respect to each of the rows, the first terminals of the LEDs in the row are connected to the scan line corresponding to the row. With respect to each of the columns, the second terminals of the LEDs in the column are connected to the drive line corresponding to the column. The driving device includes a current driver, a scan selector and a capacitor. The current driver is connected to the drive lines, and provides a plurality of driving current signals respectively to the drive lines. The scan selector is connected to the scan lines, and has a first terminal that is configured to receive an input voltage, and a second terminal. The scan selector outputs the input voltage to a selected one of the scan lines, and outputs a clamp voltage provided at the second terminal of the scan selector to the other ones of the scan lines. The capacitor has a first terminal, and a second terminal that is connected to the second terminal of the scan selector.

According to another aspect of the disclosure, the driving device is operatively associated with a light emitting diode (LED) array. The LED array includes a plurality of scan lines, a plurality of drive lines and a plurality of LEDs. The LEDs are arranged in a matrix that has a plurality of rows respectively corresponding to the scan lines and a plurality of columns respectively corresponding to the drive lines. Each of the LEDs has a first terminal and a second terminal. With respect to each of the rows, the first terminals of the LEDs in the row are connected to the scan line corresponding to the row. With respect to each of the columns, the second terminals of the LEDs in the column are connected to the drive line corresponding to the column. The driving device includes a current driver, a scan selector and a capacitor. The current driver is adapted to be connected to the drive lines, and provides a plurality of driving current signals respectively to the drive lines. The scan selector is adapted to be connected to the scan lines, and has a first terminal that is configured to receive an input voltage, and a second terminal. The scan selector outputs the input voltage to a selected one of the scan lines, and outputs a clamp voltage provided at the second terminal of the scan selector to the other ones of the scan lines. The capacitor has a first terminal, and a second terminal that is connected to the second terminal of the scan selector.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
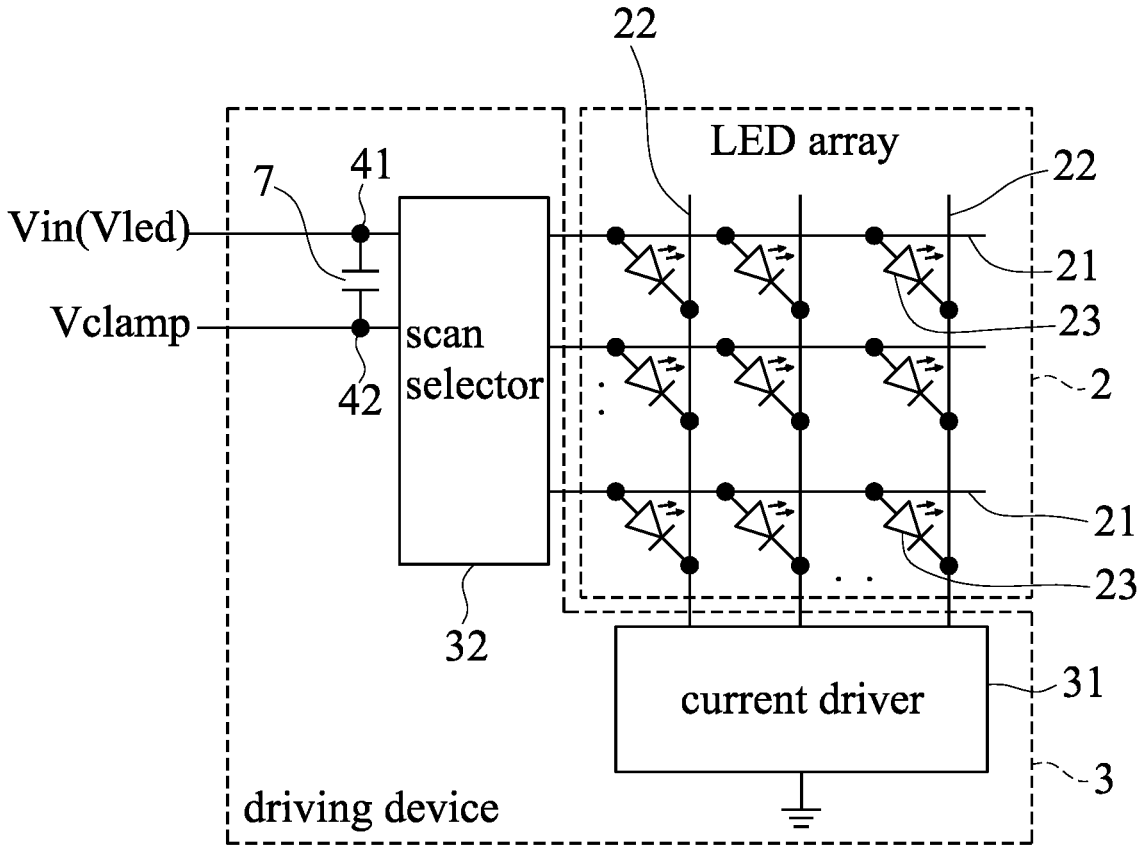
FIG. 1 is a circuit block diagram illustrating a first embodiment of a display system according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, a first embodiment of a driving system according to the disclosure includes a light emitting diode (LED) array 2 and a driving device 3.

The LED array 2 has a common anode configuration, and includes a plurality of scan lines 21, a plurality of drive lines 22, and a plurality of LEDs 23. The LEDs 23 are arranged in a matrix that has a plurality of rows respectively corresponding to the scan lines 21 and a plurality of columns respectively corresponding to the drive lines 22. Each of the LEDs 23 has a first terminal (e.g., an anode) and a second terminal (e.g., a cathode), and corresponds to a pixel. With respect to each of the rows, the first terminals (i.e., the anodes) of the LEDs in the row are connected to the scan line 21 corresponding to the row. With respect to each of the columns, the second terminals (i.e., the cathodes) of the LEDs 23 in the column are connected to the drive line 22 corresponding to the column.

The driving device 3 includes a current driver 31, a scan selector 32 and a capacitor 7.

The current driver 31 is connected to the drive lines 22, and provides a plurality of driving current signals respectively to the drive lines 22. The scan selector 32 is connected to the scan lines 21, and has a first terminal 41 and a second terminal 42. The scan selector 32 is configured to receive, via the first terminal 41 thereof, a supply voltage (Vled) that is for powering the display system and to serve as an input voltage (Vin), and outputs the input voltage (Vin) to the scan lines 21 sequentially without overlapping in time so as to drive the LEDs 23 to emit light in a line scan manner. Each row of the LEDs 23 corresponds to a respective line of the line scan of the LEDs 23. In addition, for each of the scan lines 21, the scan selector 32 outputs a clamp voltage (Vclamp) provided at the second terminal 42 of the scan selector 32 to the scan line 21 when it does not outputs the input voltage (Vin) to the scan line 21. The clamp voltage (Vclamp) is smaller than the supply voltage (Vled) in magnitude, and is greater than a ground voltage at the ground in magnitude. In other words, for each line of the line scan of the LEDs 23, during an active time of the line of the line scan, the scan selector 32 outputs the input voltage (Vin) to one of the scan lines 21 that corresponds to the row corresponding to the line of the line scan, and outputs the clamp voltage (Vclamp) to the other ones of the scan lines 21. The capacitor 7 has a first terminal that is connected to the first terminal 41 of the scan selector 32, and a second terminal that is connected to the second terminal 42 of the scan selector 32.

Figure 10:
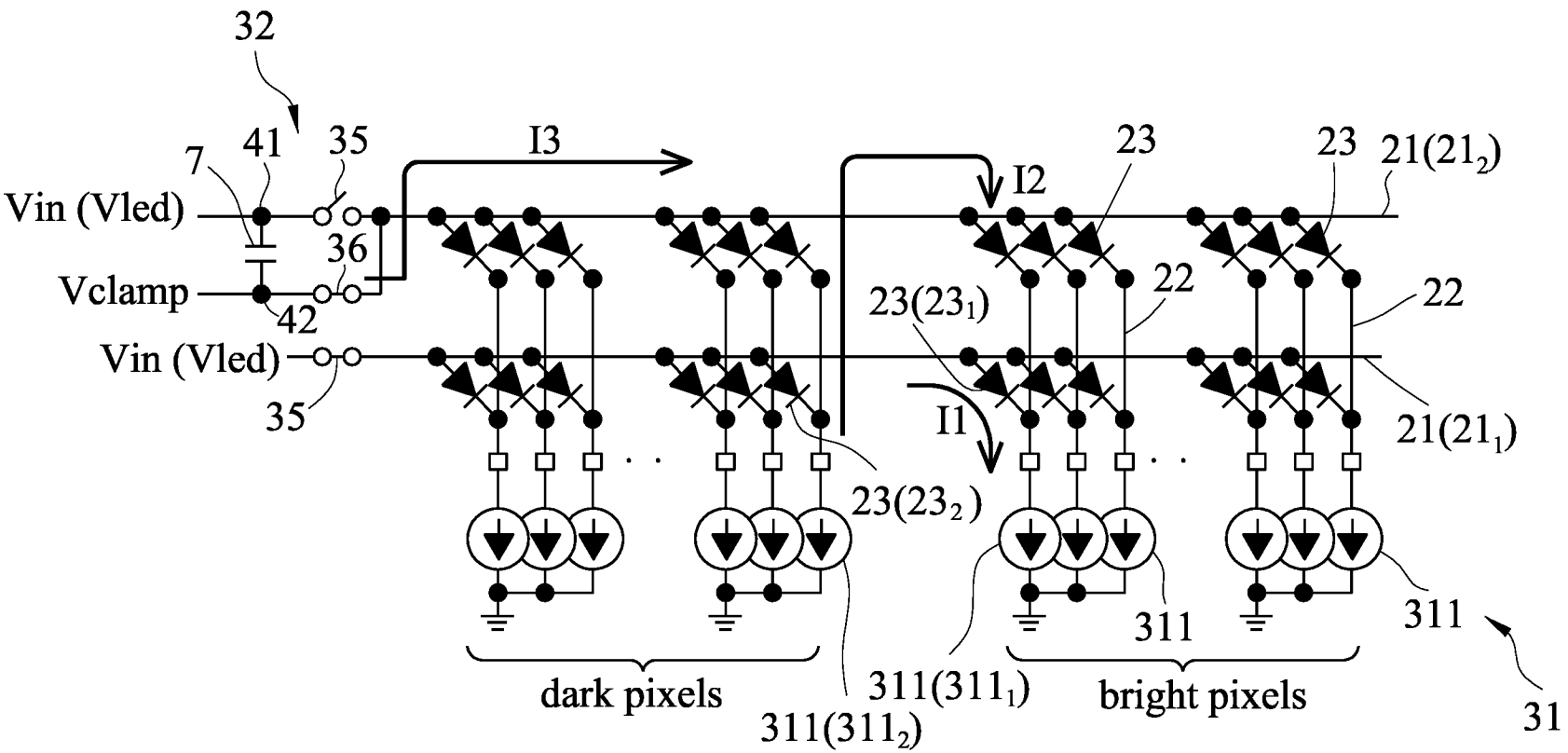
FIG. 10 is a circuit diagram illustrating operations of the first embodiment.

In this embodiment, as shown in FIG. 10, the current driver 31 includes a plurality of current sources 311 that are respectively connected to the drive lines 22 and that respectively generate the driving current signals. Each of the driving current signals has a non-zero magnitude when the corresponding current source 311 is enabled, and has a zero magnitude when the corresponding current source 311 is disabled. For each line of the line scan of the LEDs 23, during the active time of the line of the line scan, the current source 311 for driving the LED 23 corresponding to a bright pixel is enabled before the current source 311 for driving the LED 23 corresponding to a dark pixel is enabled. It should be noted that, in other embodiments, for each line of the line scan of the LEDs 23, during the active time of the line of the line scan, the current source 311 for driving the LED 23 corresponding to a bright pixel and the current source 311 for driving the LED 23 corresponding to a dark pixel may be enabled at the same time.

Figure 2:
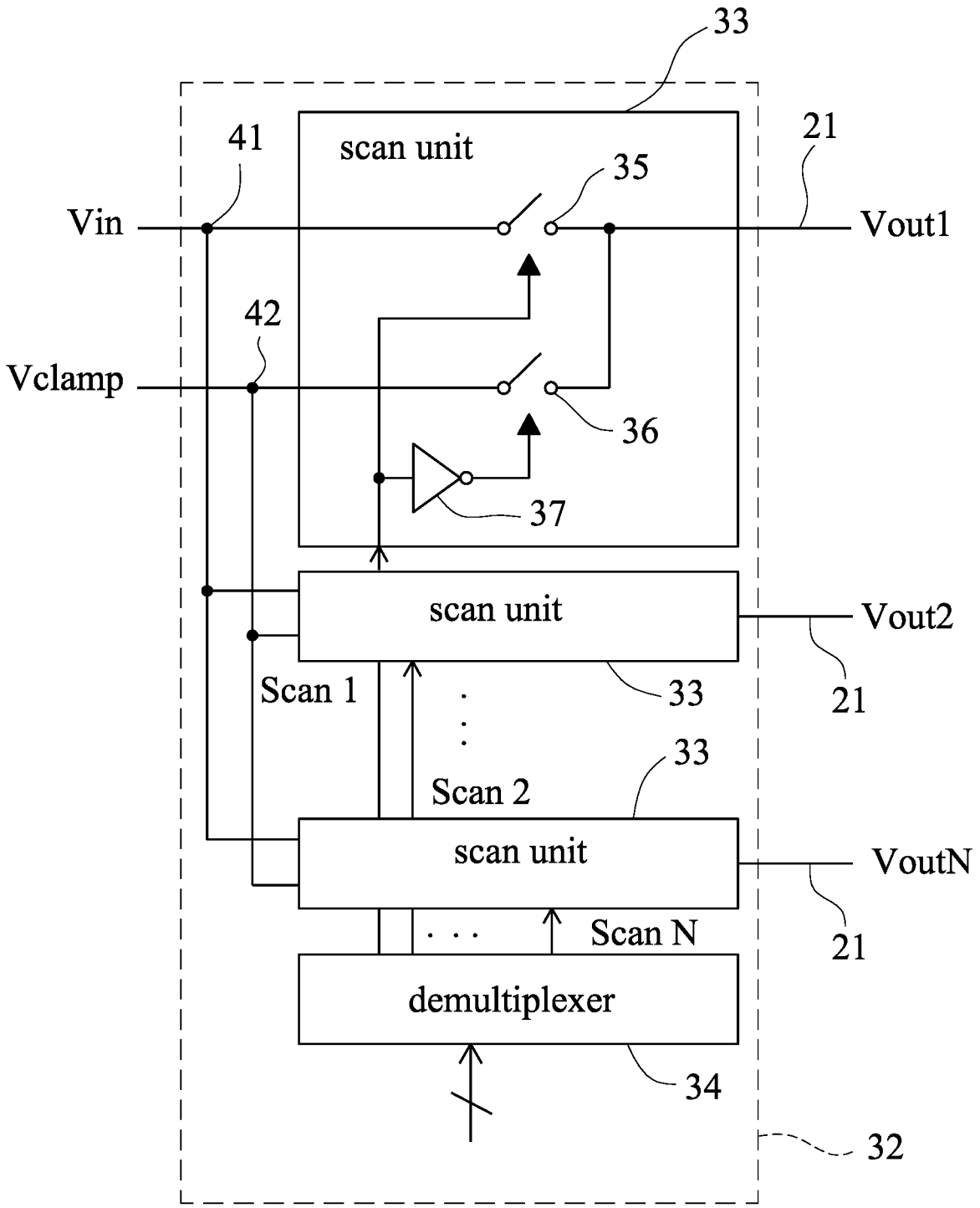
FIG. 2 is a circuit block diagram illustrating a scan selector of the first embodiment.

Referring to FIG. 2, in this embodiment, the scan selector 32 includes a plurality of scan units 33 respectively corresponding to the scan lines 21, and a demultiplexer 34. Each of the scan units 33 includes a scan switch 35, a clamp switch 36 and an inverter 37. The inverter 37 has an input terminal that is configured to receive a switching signal (Scan1/Scan2/ . . . /ScanN), and an output terminal. The scan switch 35 has a first terminal that is connected to the first terminal 41 of the scan selector 32, a second terminal that is connected to the scan line 21 corresponding to the scan unit 33, and a control terminal that is connected to the input terminal of the inverter 37. The scan switch 35, when conducting, permits transmission of the input voltage (Vin) from the first terminal 41 of the scan selector 32 to the scan line 21 corresponding to the scan unit 33. The clamp switch 36 has a first terminal that is connected to the second terminal 42 of the scan selector 32, a second terminal that is connected to the scan line 21 corresponding to the scan unit 33, and a control terminal that is connected to the output terminal of the inverter 37. The clamp switch 36, when conducting, permits transmission of the clamp voltage (Vclamp) from the second terminal 42 of the scan selector 32 to the scan line 21 corresponding to the scan unit 33. The scan unit 33 is switchable between a first operation state where the scan switch 35 thereof conducts while the clamp switch 36 thereof does not conduct, and a second operation state where the scan switch 35 thereof does not conduct while the clamp switch 36 thereof conducts. The demultiplexer 34 is connected to the input terminal of the inverter 37 of each of the scan units 33, is configured to receive a scan control input, and generates, based on the scan control signal, the switching signals (Scan1-ScanN) to respectively control the switching of the scan units 33 between the first and second operation states.

Figure 3:
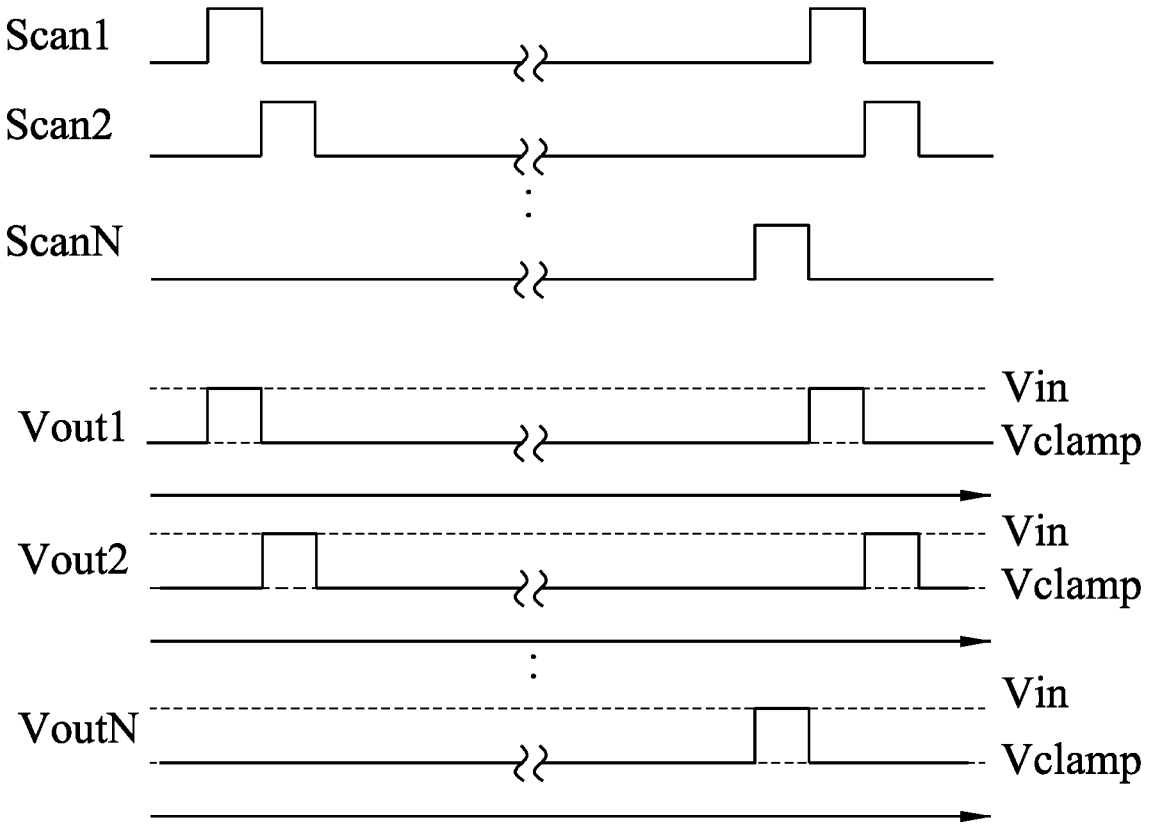
FIG. 3 is a timing diagram illustrating operations of the scan selector.

Referring to FIGS. 1 to 3, FIG. 3 illustrates the switching signals (Scan1-ScanN) and voltages (Vout1-VoutN) respectively at the scan lines 21. In this embodiment, the scan control input is configured in such a way that each of the switching signals (Scan1-ScanN) switches between an active logic level (e.g., a logic high level) corresponding to the first operation state of the corresponding switch unit 33 and an inactive logic level (e.g., a logic low level) corresponding to the second operation state of the corresponding switch unit 33, and timing of the active logic level of the switching signals (Scan1-ScanN) are staggered and non-overlapping in each line scan cycle of the LEDs 23. Therefore, for each line of the line scan of the LEDs 23, during the active time of the line of the line scan (i.e., a time where the corresponding switching signal (Scan1/Scan2/ . . . /ScanN) is at the active logic level), the scan selector 32 outputs the input voltage (Vin) to the corresponding scan line 21, and outputs the clamp voltage (Vclamp) to the other scan lines 21.

In this embodiment, the scan selector 32 is adapted to be connected to a power supply (not shown) via the first terminal 41 of the scan selector 32 to receive the supply voltage (Vled) serving as the input voltage (Vin), and generates the clamp voltage (Vclamp) at the second terminal 42 of the scan selector 32.

Figure 4:
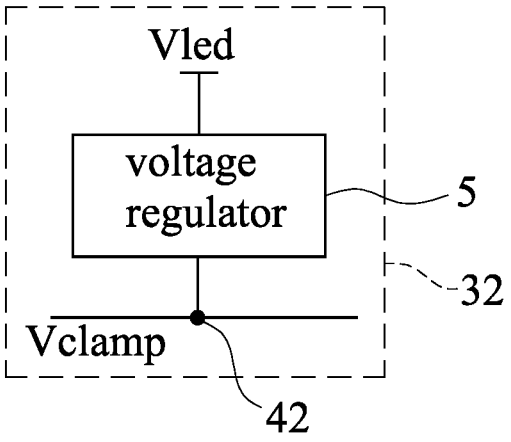
FIG. 4 is a block diagram illustrating a first way to generate a clamp voltage, where the scan selector further includes a voltage regulator.
Figure 5:
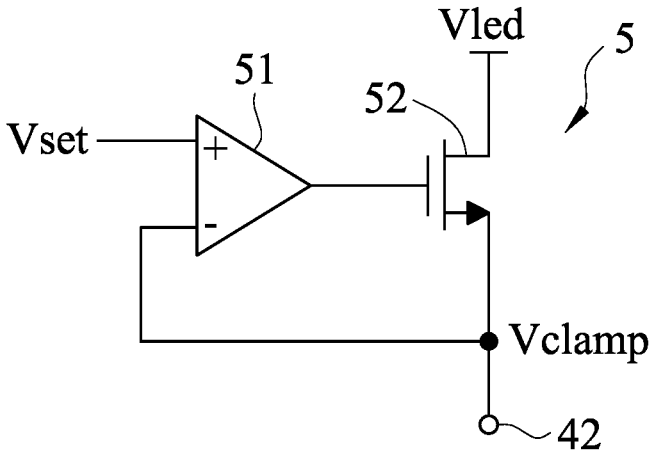
FIG. 5 is a circuit diagram illustrating an example of the voltage regulator.

Referring to FIG. 4, in a first implementation of this embodiment, the scan selector 32 further includes a voltage regulator 5. The voltage regulator 5 is connected to the second terminal 42 of the scan selector 32, and generates the clamp voltage (Vclamp) at the second terminal 42 of the scan selector 32. Referring to FIGS. 4 and 5, in an example, the voltage regulator 5 includes an amplifier 51 and a transistor 52. The amplifier 51 has a first input terminal (e.g., a non-inverting input terminal) that is configured to receive a set voltage (Vset), a second input terminal (e.g., an inverting input terminal) that is connected to the second terminal 42 of the scan selector 32, and an output terminal. The transistor 52 (e.g., an N-type metal oxide semiconductor field effect transistor (nMOSFET)) has a first terminal (e.g., a drain terminal) that is configured to receive the supply voltage (Vled), a second terminal (e.g., a source terminal) that is connected to the second terminal 42 of the scan selector 32, and a control terminal (e.g., a gate terminal) that is connected to the output terminal of the amplifier 51. The voltage regulator 5 generates, at the second terminal 42 of the scan selector 32, the clamp voltage (Vclamp) that is equal to the set voltage (Vset) in magnitude.

Figure 6:
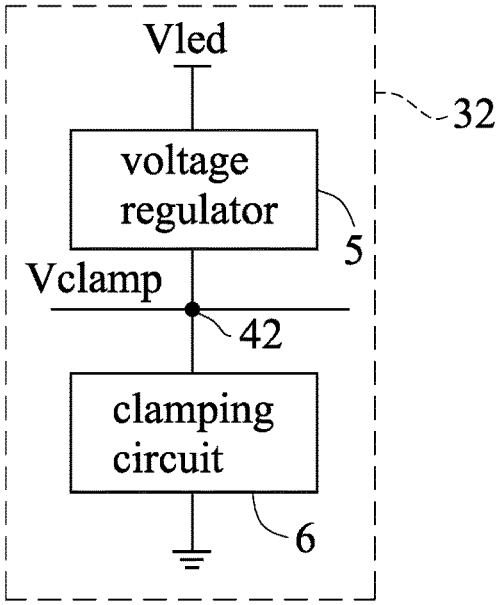
FIG. 6 is a block diagram illustrating a second way to generate the clamp voltage, where the scan selector further includes the voltage regulator and a clamping circuit.
Figure 7:
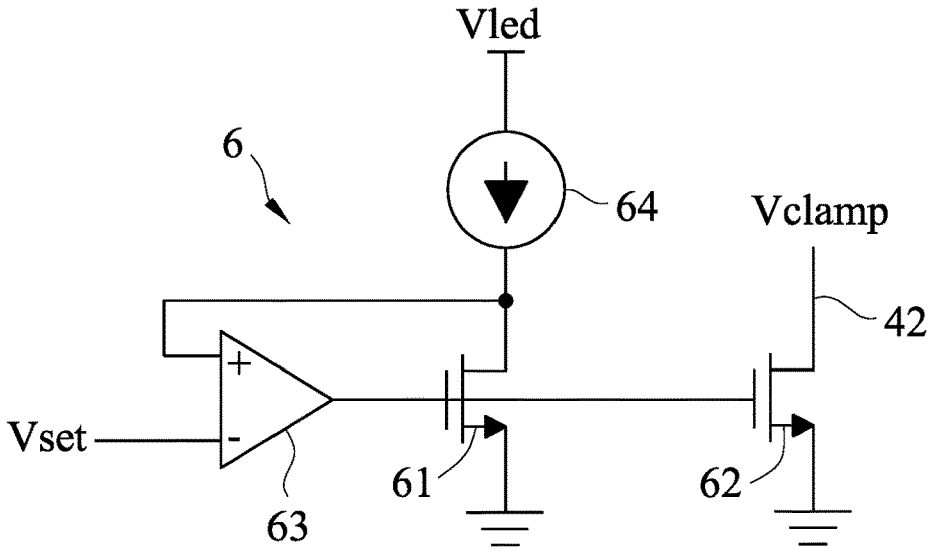
FIG. 7 is a circuit diagram illustrating an example of the clamping circuit.

Referring to FIG. 6, a second implementation of this embodiment is similar to the first implementation of this embodiment, but differs from the first implementation of this embodiment in that the scan selector 32 further includes a clamping circuit 6. The clamping circuit 6 is connected to the second terminal 42 of the scan selector 32, and clamps the clamp voltage (Vclamp) provided at the second terminal 42 of the scan selector 32. Referring to FIGS. 6 and 7, in an example, the clamping circuit 6 includes an amplifier 63, two transistors 61, 62 and a current source 64. The amplifier 63 has a first input terminal (e.g., a non-inverting input terminal), a second input terminal (e.g., an inverting input terminal) that is configured to receive the set voltage (Vset), and an output terminal. The transistor 61 (e.g., an nMOSFET) has a first terminal (e.g., a drain terminal) that is connected to the first input terminal of the amplifier 63, a second terminal (e.g., a source terminal) that is connected to the ground, and a control terminal (e.g., a gate terminal) that is connected to the output terminal of the amplifier 63. The transistor 62 (e.g., an nMOSFET) has a first terminal (e.g., a drain terminal) that is connected to the second terminal 42 of the scan selector 32, a second terminal (e.g., a source terminal) that is connected to the ground, and a control terminal (e.g., a gate terminal) that is connected to the output terminal of the amplifier 63. The current source 64 is connected to the first terminal of the transistor 61, is configured to receive the supply voltage (Vled), and generates a current that is sourced from the supply voltage (Vled) and that flows through the transistor 61. The clamping circuit 6 clamps the clamp voltage (Vclamp) to be equal to the set voltage (Vset) in magnitude.

Figure 8:
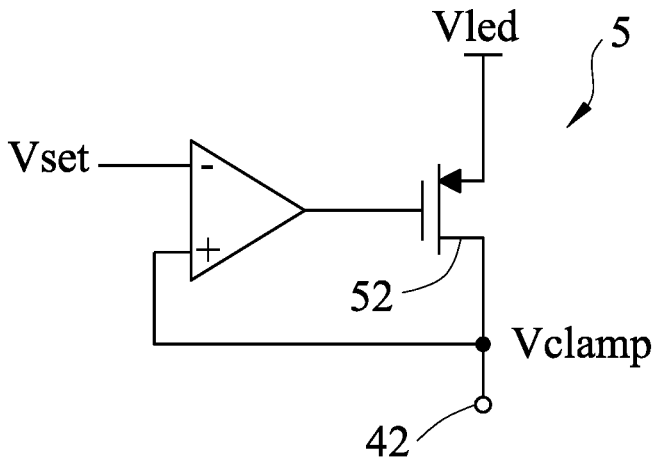
FIG. 8 is a circuit diagram illustrating another example of the voltage regulator.

FIG. 8 illustrates another example of the voltage regulator 5. The another example of the voltage regulator 5 as shown in FIG. 8 is similar to the example of the voltage regulator 5 as shown in FIG. 5, but differs in that: (a) the first input terminal of the amplifier 51 is an inverting input terminal; (b) the second input terminal of the amplifier 51 is a non-inverting input terminal; and (c) the transistor 52 is a P-type metal oxide semiconductor field effect transistor (pMOSFET) having a source terminal, a drain terminal and a gate terminal that respectively serve as the first terminal, the second terminal and the control terminal of the transistor 52.

Figure 9:
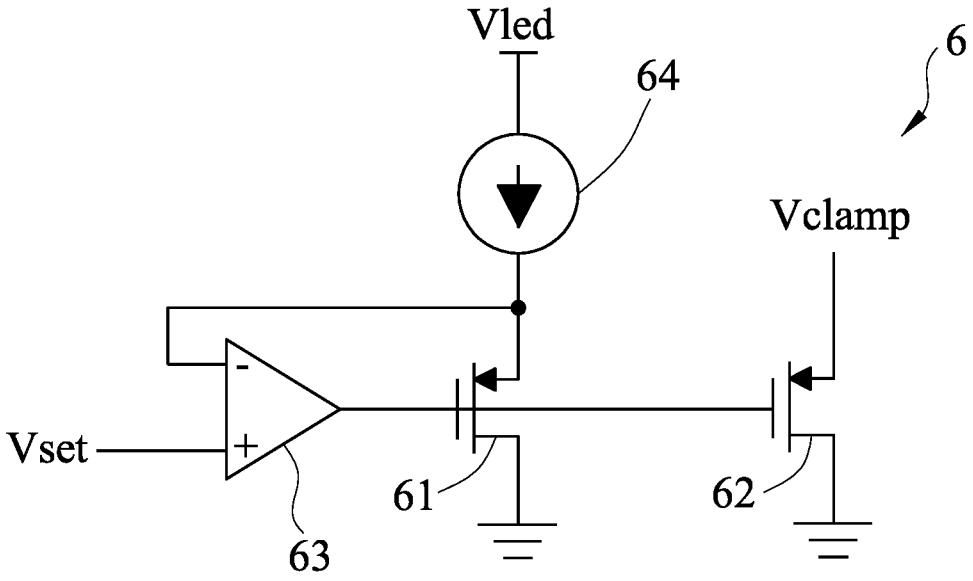
FIG. 9 is a circuit diagram illustrating another example of the clamping circuit.

FIG. 9 illustrates another example of the clamping circuit 6. The another example of the clamping circuit 6 as shown in FIG. 9 is similar to the example of the clamping circuit 6 as shown in FIG. 7, but differs in that: (a) the first input terminal of the amplifier 63 is an inverting input terminal; (b) the second input terminal of the amplifier 63 is a non-inverting input terminal; and (c) each of the transistors 61, 62 is a pMOSFET having a source terminal, a drain terminal and a gate terminal that respectively serve as the first terminal, the second terminal and the control terminal of the transistor 61/62.

Referring to FIG. 10, in this embodiment, by virtue of having the capacitor 7 connected to the second terminal 42 of the scan selector 32, the cross-channel coupling problem can be eliminated. For convenience of explanation, only two of the scan lines 21 and the corresponding two rows of the LEDs 23 are depicted in FIG. 10. The two scan lines 21 depicted in FIG. 10 are hereinafter respectively referred to as a first scan line $\mathbf{21}_1$ and a second scan line $\mathbf{21}_2$. The first scan line $\mathbf{21}_1$ is supplied with the input voltage (Vin), and the LEDs 23 connected to the first scan line $\mathbf{21}_1$ can emit light. The second scan line $\mathbf{21}_2$ is supplied with the clamp voltage (Vclamp), and the LEDs 23 connected to the second scan line $\mathbf{21}_2$ do not emit light. The current source 311 (hereinafter referred to as the first current source $\mathbf{311}_1$) for driving the LED 23 (hereinafter referred to as the first LED $\mathbf{23}_1$) that is connected to the first scan line $\mathbf{21}_1$ and that corresponds to a bright pixel is enabled before the current source 311 (hereinafter referred to as the second current source $\mathbf{311}_2$) for driving the LED 23 (hereinafter referred to as the second LED $\mathbf{23}_2$) that is connected to the first scan line $\mathbf{21}_1$ and that corresponds to a dark pixel is enabled. Upon the enabling of the first current source $\mathbf{311}_1$, the first current source $\mathbf{311}_1$ causes the drive current signal generated thereby to have a fixed non-zero magnitude, only a portion of the drive current signal would flow through the first LED $\mathbf{23}_1$ (see a current path (I1) shown in FIG. 10) since a voltage across the first LED $\mathbf{23}_1$ is not sufficiently large, and another portion of the drive current signal (i.e., a coupling current) would flow through the capacitor 7 (see a current path (I3) shown in FIG. 10) instead of through a parasitic capacitance of the second LED $23_2$ (see a current path (I2) shown in FIG. 10). Therefore, a voltage across the second LED $23_2$ would not change before the second current source $311_2$ is enabled, thereby eliminating the cross-channel coupling problem.

Figure 11:
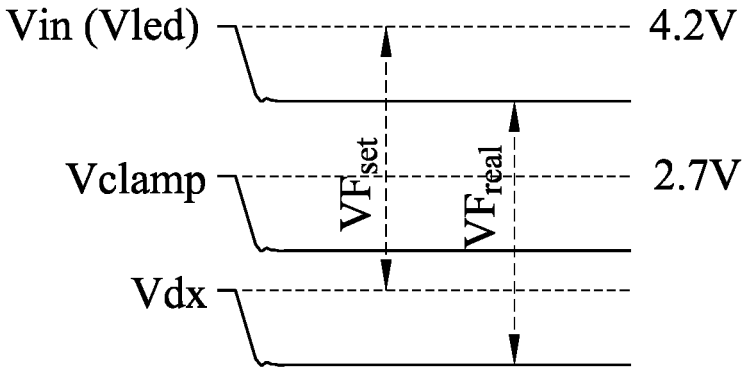
FIG. 11 is a timing diagram illustrating operations of the first embodiment.

Referring to FIGS. 10 and 11, in this embodiment, when the magnitude of the input voltage (Vin) drops below its predetermined value (e.g., 4.2V) because of a current flowing through a power line for delivering the input voltage (Vin), the magnitude of the clamp voltage (Vclamp) would drop below its predetermined value (e.g., 2.7V) along with the magnitude of the input voltage (Vin) by substantially the same amount because of the capacitor 7 connected between the first and second terminals 42 of the scan selector 32, and a magnitude of a voltage (Vdx) at any one of the drive lines 22 drops along with the magnitude of the clamp voltage (Vclamp) by substantially the same amount because of the parasitic capacitances of the LEDs 23 each connected between the drive line 22 and a respective one of the scan lines 21 supplied with the clamp voltage (Vclamp), making a magnitude difference ($VF_{real}$) between the input voltage (Vin) and the voltage (Vdx) substantially equal to a magnitude difference ($VF_{set}$) between the input voltage (Vin) and the voltage (Vdx) prior to the drop of the input voltage (Vin). Therefore, the voltage across each of the LEDs 23 is minimally affected by the drop of the input voltage (Vin) before the current source 311 for driving the LED 23 is enabled, so each pixel can have the expected brightness.

Figure 12:
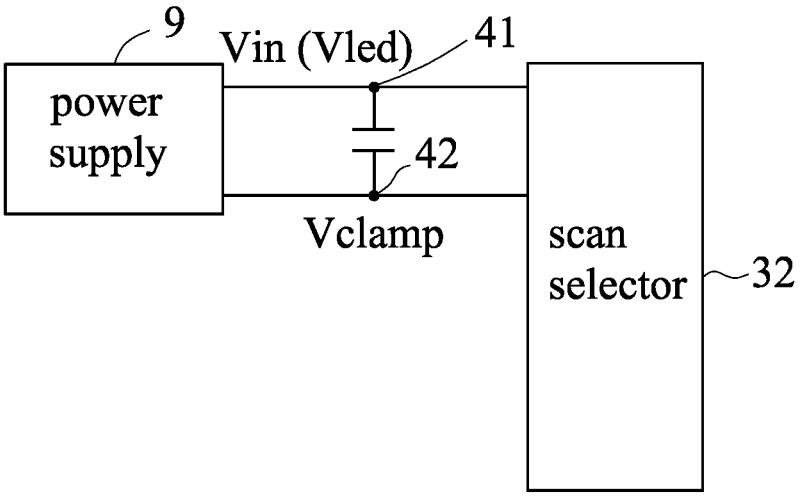
FIG. 12 is a circuit block diagram illustrating a third way to generate the clamp voltage.

Referring to FIG. 12, in a first modification of the first embodiment, the scan selector 32 does not generate the clamp voltage (Vclamp) at the second terminal 42 thereof (i.e., the voltage regulator 5 as shown in FIG. 4 or a combination of the voltage regulator 5 and the clamping circuit 6 as shown in FIG. 6 is omitted), and is configured to receive the clamp voltage (Vclamp) via the second terminal 42 of the scan selector 32 from a power supply 9 that also provides the supply voltage (Vled) received by the scan selector 32 via the first terminal 41 of the scan selector 32 to serve as the input voltage (Vin).

Figure 13:
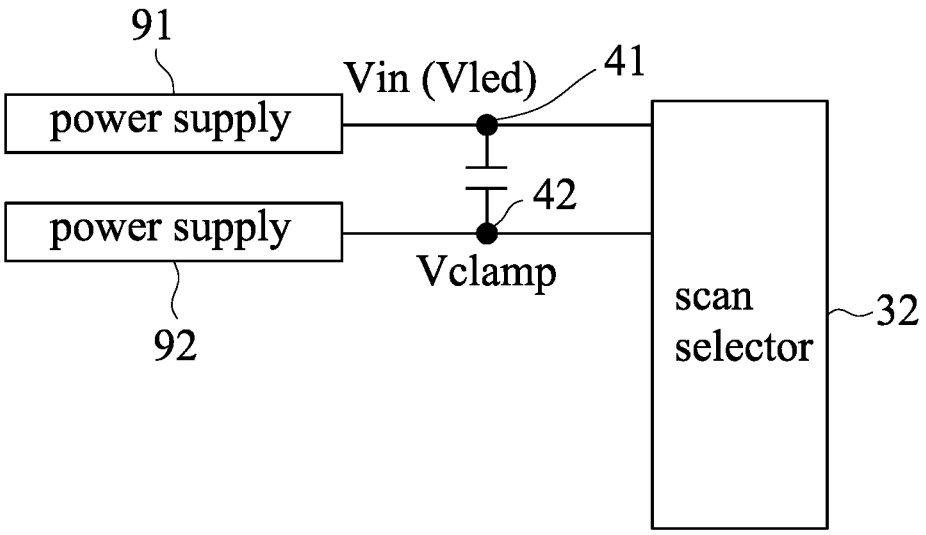
FIG. 13 is a circuit block diagram illustrating a fourth way to generate the clamp voltage.

Referring to FIG. 13, a second modification of the first embodiment is similar to the first modification of the first embodiment, but differs from the first modification of the first embodiment in that the scan selector 32 receives the supply voltage (Vled) and the clamp voltage (Vclamp) respectively from two separate power supplies 91, 92.

Figure 14:
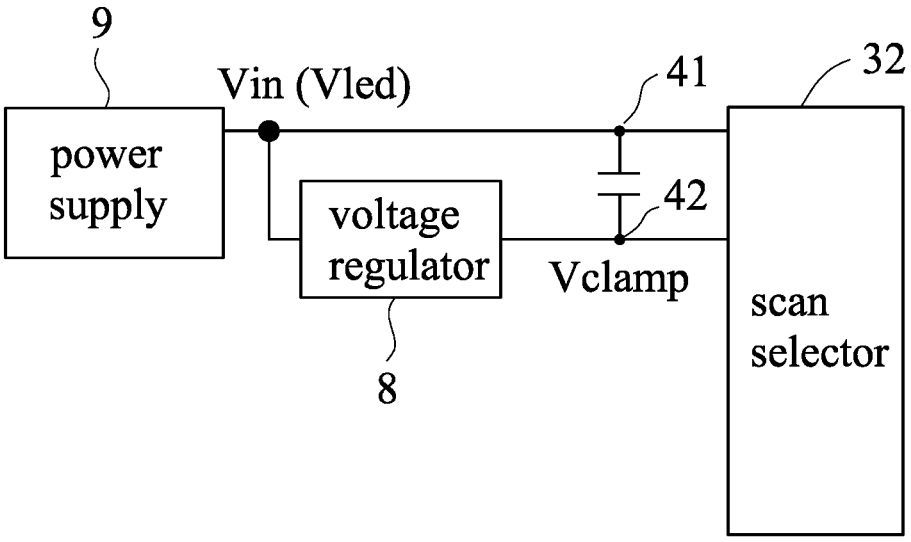
FIG. 14 is a circuit block diagram illustrating a fifth way to generate the clamp voltage.

Referring to FIG. 14, a third modification of the first embodiment is similar to the first modification of the first embodiment, but differs from the first modification of the first embodiment in that the scan selector 32 receives the clamp voltage (Vclamp) from a voltage regulator 8 powered by the supply voltage (Vled) from the power supply 9.

Figure 15:
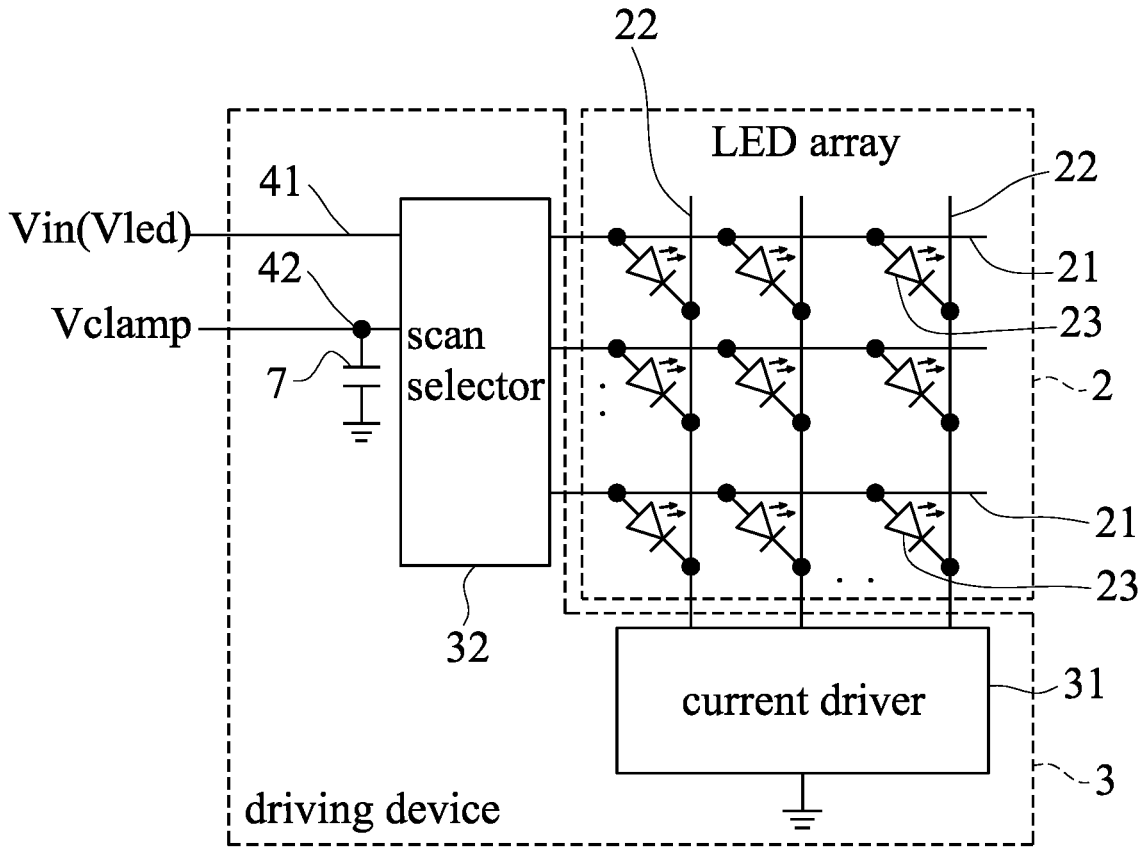
FIG. 15 is a circuit block diagram illustrating a second embodiment of the display system according to the disclosure.

Referring to FIG. 15, a second embodiment of the display system according to the disclosure is similar to the first embodiment, but differs from the first embodiment in that the first terminal of the capacitor 7 is connected to the ground.

In the second embodiment, by virtue of having the capacitor 7 connected to the second terminal 42 of the scan selector 32, the cross-channel coupling problem can be eliminated.

Figure 16:
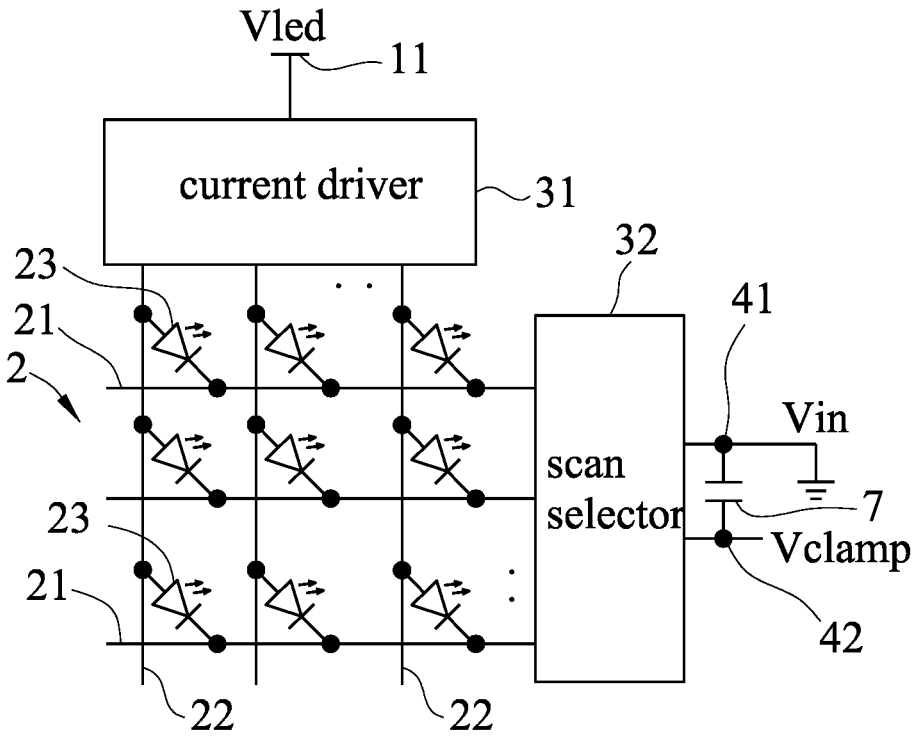
FIG. 16 is a circuit block diagram illustrating a third embodiment of the display system according to the disclosure.

Referring to FIG. 16, a third embodiment of the display system according to the disclosure is similar to the first embodiment, but differs from the first embodiment in that: (a) the LED array 2 has a common cathode configuration (i.e., the first terminal of each of the LEDs 23 is a cathode, the second terminal of each of the LEDs 23 is an anode); and (b) the first terminal 41 of the scan selector 32 is connected to the ground to receive the ground voltage that serves as the input voltage (Vin).

In the third embodiment, by virtue of having the capacitor 7 connected to the second terminal 42 of the scan selector 32, the cross-channel coupling problem can be eliminated.

In addition, by virtue of having the capacitor 7 connected between the first and second terminals 42 of the scan selector 32, the voltage across each of the LEDs 23 is minimally affected by a rise of the input voltage (Vin) before the current source 311 (see FIG. 10) for driving the LED 23 is enabled, so each pixel can have the expected brightness.

Figure 17:
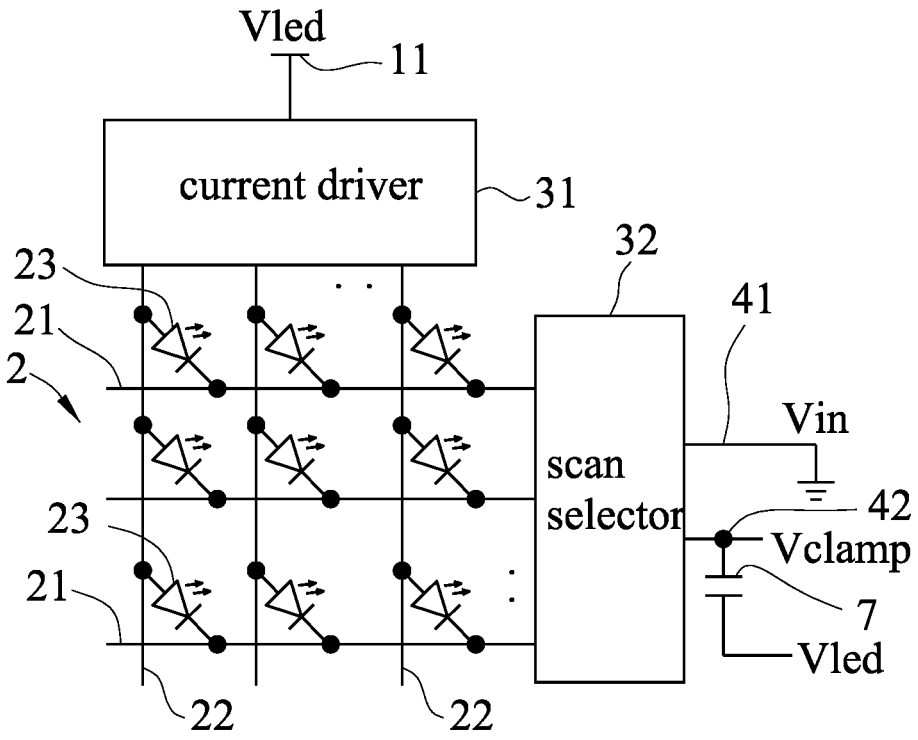
FIG. 17 is a circuit block diagram illustrating a fourth embodiment of the display system according to the disclosure.

Referring to FIG. 17, a fourth embodiment of the display system according to the disclosure is similar to the third embodiment, but differs from the third embodiment in that the first terminal of the capacitor 7 is connected to a power node 11 to receive the supply voltage (Vled).

In the fourth embodiment, by virtue of having the capacitor 7 connected to the second terminal 42 of the scan selector 32, the cross-channel coupling problem can be eliminated.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

What is claimed is:

1. A display system comprising:

a light emitting diode (LED) array including a plurality of scan lines, a plurality of drive lines, and a plurality of LEDs arranged in a matrix that has a plurality of rows respectively corresponding to said scan lines and a plurality of columns respectively corresponding to said drive lines, each of said LEDs having a first terminal and a second terminal, with respect to each of said rows, said first terminals of said LEDs in said row being connected to said scan line corresponding to said row, with respect to each of said columns, said second terminals of said LEDs in said column being connected to said drive line corresponding to said column;

a driving device including a current driver connected to said drive lines, and providing a plurality of driving current signals respectively to said drive lines, a scan selector connected to said scan lines, and having a first terminal that is configured to receive an input voltage, and a second terminal, said scan selector outputting the input voltage to a selected one of said scan lines, and outputting a clamp voltage provided at said second terminal of said scan selector to the other ones of said scan lines, and a capacitor having a first terminal, and a second terminal that is connected to said second terminal of said scan selector.

2. The display system of claim 1, wherein:

said first terminal of each of said LEDs is an anode;

said second terminal of each of said LEDs is a cathode; and the input voltage being a supply voltage that is for powering said display system, and that is greater than the clamp voltage in magnitude.

3. The display system of claim 2, wherein said first terminal of said capacitor is connected to said first terminal of said scan selector.

4. The display system of claim 2, wherein said first terminal of said capacitor is connected to the ground, at which a ground voltage is smaller than the clamp voltage in magnitude.

5. The display system of claim 1, wherein:

said first terminal of each of said LEDs is a cathode;

said second terminal of each of said LEDs is an anode;

the input voltage being a ground voltage that is smaller than the clamp voltage in magnitude.

6. The display system of claim 5, wherein said first terminal of said capacitor is connected to said first terminal of said scan selector.

7. The display system of claim 5, wherein said first terminal of said capacitor is connected to a power node to receive a supply voltage that is for powering said display system, and that is greater than the clamp voltage in magnitude.

8. The display system of claim 1, wherein:

said scan selector includes a plurality of scan units respectively corresponding to said scan lines;

each of said scan units includes a scan switch having a first terminal that is connected to said first terminal of said scan selector, and a second terminal that is connected to said scan line corresponding to said scan unit, said scan switch, when conducting, permitting transmission of the input voltage from said first terminal of said scan selector to said scan line corresponding to said scan unit, and a clamp switch having a first terminal that is connected to said second terminal of said scan selector, and a second terminal that is connected to said scan line corresponding to said scan unit, said clamp switch, when conducting, permitting transmission of the clamp voltage from said second terminal of said scan selector to said scan line corresponding to said scan unit; and each of said scan units is switchable between a first operation state where said scan switch thereof conducts while said clamp switch thereof does not conduct, and a second operation state where said scan switch thereof does not conduct while said clamp switch thereof conducts.

9. The display system of claim 8, wherein said scan selector further includes a demultiplexer that is connected to said scan units, that is configured to receive a scan control input, and that generates, based on the scan control signal, a plurality of switching signal to respectively control switching of said scan units between the first and second operation states.

10. The display system of claim 1, wherein said scan selector includes a voltage regulator that is connected to said second terminal of said scan selector, and that generates the clamp voltage at said second terminal of said scan selector.

11. The display system of claim 10, wherein said voltage regulator includes:

an amplifier having a first input terminal that is configured to receive a set voltage, a second input terminal that is connected to said second terminal of said scan selector, and an output terminal; and a transistor having a first terminal that is configured to receive a supply voltage, a second terminal that is connected to said second terminal of said scan selector, and a control terminal that is connected to said output terminal of said amplifier.

12. The display system of claim 11, wherein:

said first input terminal of said amplifier is a non-inverting input terminal;

said second input terminal of said amplifier is an inverting input terminal; and said transistor is an N-type metal oxide semiconductor field effect transistor having a drain terminal, a source terminal and a gate terminal that respectively serve as said first terminal, said second terminal and said control terminal of said transistor.

13. The display system of claim 11, wherein:

said first input terminal of said amplifier is an inverting input terminal;

said second input terminal of said amplifier is a non-inverting input terminal; and said transistor is a P-type metal oxide semiconductor field effect transistor having a source terminal, a drain terminal and a gate terminal that respectively serve as said first terminal, said second terminal and said control terminal of said transistor.

14. The display system of claim 10, wherein said scan selector further includes a clamping circuit that is connected to said second terminal of said scan selector, and that clamps the clamp voltage provided at said second terminal of said scan selector.

15. The display system of claim 14, wherein said clamping circuit includes:

an amplifier having a first input terminal, a second input terminal that is configured to receive a set voltage, and an output terminal;

a first transistor having a first terminal that is connected to said first input terminal of said amplifier, a second terminal that is connected to the ground, and a control terminal that is connected to said output terminal of said amplifier;

a second transistor having a first terminal that is connected to said second terminal of said scan selector, a second terminal that is connected to the ground, and a control terminal that is connected to said output terminal of said amplifier; and a current source connected to said first terminal of said first transistor.

16. The display system of claim 15, wherein:

said first input terminal of said amplifier is a non-inverting input terminal;

said second input terminal of said amplifier is an inverting input terminal; and each of said first and second transistors is an N-type metal oxide semiconductor field effect transistor having a drain terminal, a source terminal and a gate terminal that respectively serve as said first terminal, said second terminal and said control terminal of said transistor.

17. The display system of claim 15, wherein:

said first input terminal of said amplifier is an inverting input terminal;

said second input terminal of said amplifier is a non-inverting input terminal; and each of said first and second transistors is a P-type metal oxide semiconductor field effect transistor having a source terminal, a drain terminal and a gate terminal that respectively serve as said first terminal, said second terminal and said control terminal of said transistor.

18. A driving device operatively associated with a light emitting diode (LED) array, the LED array including a plurality of scan lines, a plurality of drive lines and a plurality of LEDs, the LEDs being arranged in a matrix that has a plurality of rows respectively corresponding to the scan lines and a plurality of columns respectively corresponding to the drive lines, each of the LEDs having a first terminal and a second terminal, with respect to each of the rows, the first terminals of the LEDs in the row being connected to the scan line corresponding to the row, with respect to each of the columns, the second terminals of the LEDs in the column being connected to the drive line corresponding to the column, said driving device comprising:

a current driver adapted to be connected to the drive lines, and providing a plurality of driving current signals respectively to the drive lines;

a scan selector adapted to be connected to the scan lines, and having a first terminal that is configured to receive an input voltage, and a second terminal, said scan selector outputting the input voltage to a selected one of the scan lines, and outputting a clamp voltage provided at said second terminal of said scan selector to the other ones of the scan lines; and a capacitor having a first terminal, and a second terminal that is connected to said second terminal of said scan selector.

* * * * *